US008018306B2

(12) United States Patent
Shin et al.

(10) Patent No.: US 8,018,306 B2
(45) Date of Patent: Sep. 13, 2011

(54) RESONATOR HAVING A THREE DIMENSIONAL DEFECTED GROUND STRUCTURE IN TRANSMISSION LINE

(75) Inventors: Im-Seob Shin, Seoul (KR); In-Sun Kim, Daejeon (KR); Si-Chan Ryoo, Daejeon (KR); Bon-Joong Koo, Daejeon (KR)

(73) Assignee: Agency for Defense Development, Daejeon-si (KR)

( * ) Notice: Subject to any disclaimer, the term of this patent is extended or adjusted under 35 U.S.C. 154(b) by 213 days.

(21) Appl. No.: 12/480,081

(22) Filed: Jun. 8, 2009

(65) Prior Publication Data

US 2010/0097163 A1 Apr. 22, 2010

(30) Foreign Application Priority Data

Oct. 21, 2008 (KR) ..... 10-2008-0103045

(51) Int. Cl.
*H01P 7/00* (2006.01)
*H01P 3/08* (2006.01)

(52) U.S. Cl. ..... 333/219; 333/238

(58) Field of Classification Search ..... 333/219, 333/33, 238, 246, 204
See application file for complete search history.

(56) References Cited

U.S. PATENT DOCUMENTS

| | | | | |
|---|---|---|---|---|
| 3,863,181 | A * | 1/1975 | Glance et al. | 333/243 |
| 6,577,211 | B1 * | 6/2003 | Tsujiguchi | 333/204 |
| 6,741,142 | B1 * | 5/2004 | Okazaki et al. | 333/99 S |
| 2006/0158286 | A1 * | 7/2006 | Lai et al. | 333/238 |

FOREIGN PATENT DOCUMENTS

WO WO 2009001119 A1 * 12/2008

OTHER PUBLICATIONS

Dal Ahn et al., "A Design of the Low-Pass Filter Using the Novel Microstrip Defected Ground Structure", IEEE Transactions on Microwave Theory and Techniques, Jan. 2001, pp. 86-93, vol. 49, No. 1.

Man-Long Her et al., "Coplanar Waveguide (CPW) Defected Ground Structure (DGS) for Bandpass Filter Application", Microwave and Optical Technology Letters, Aug. 20, 2004, pp. 331-334, vol. 42, No. 4.

H.W. Liu et al., "CPW bandstop filter using periodically loaded slot resonators", Electronic Letters, Mar. 16, 2006, vol. 42, No. 6.

* cited by examiner

*Primary Examiner* — Seungsook Ham
(74) *Attorney, Agent, or Firm* — Young & Thompson

(57) ABSTRACT

A high quality resonator has a three dimensional Defected Ground Structure (DGS) in the transmission line. The resonator includes a substrate installed at the center of the resonator floating in the air through supporting members, a transmission line on the substrate, and an upper ground plane member above the substrate at a predetermined interval. A DGS pattern with a predetermined shape is on each portion of the body of the ground plane member symmetrically with respect to the transmission line. An upper cover closely contacts the upper surface of the upper ground plane member to seal the upper opening of the DGS pattern on the upper ground plane member. A lower ground plane member has the same pattern as the upper DGS, and a lower cover functions similar to the upper cover. The upper and lower members should be installed symmetrically with respect to the substrate.

18 Claims, 9 Drawing Sheets

[Fig. 1]
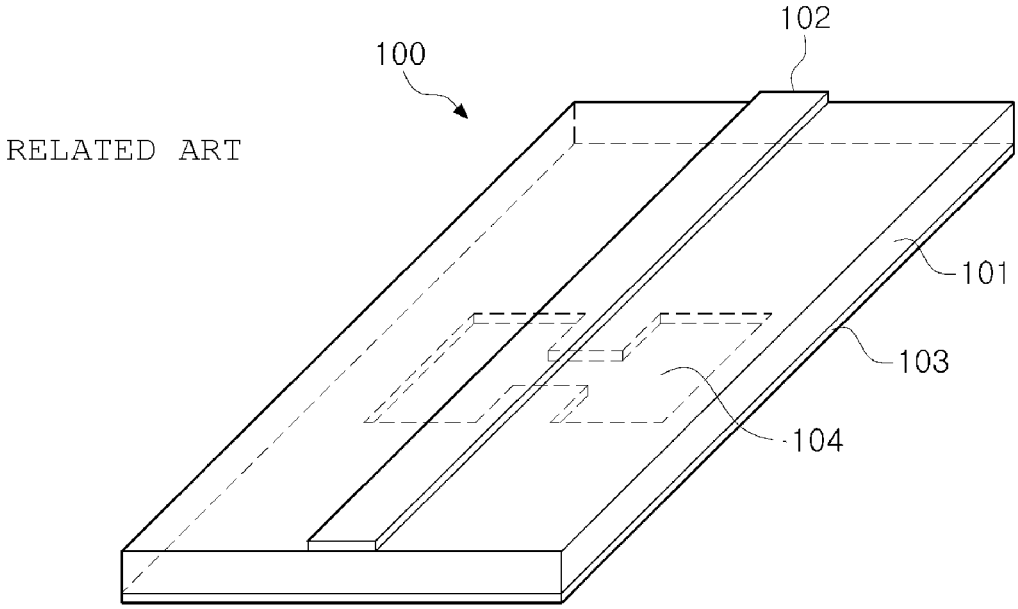
[Fig. 2]
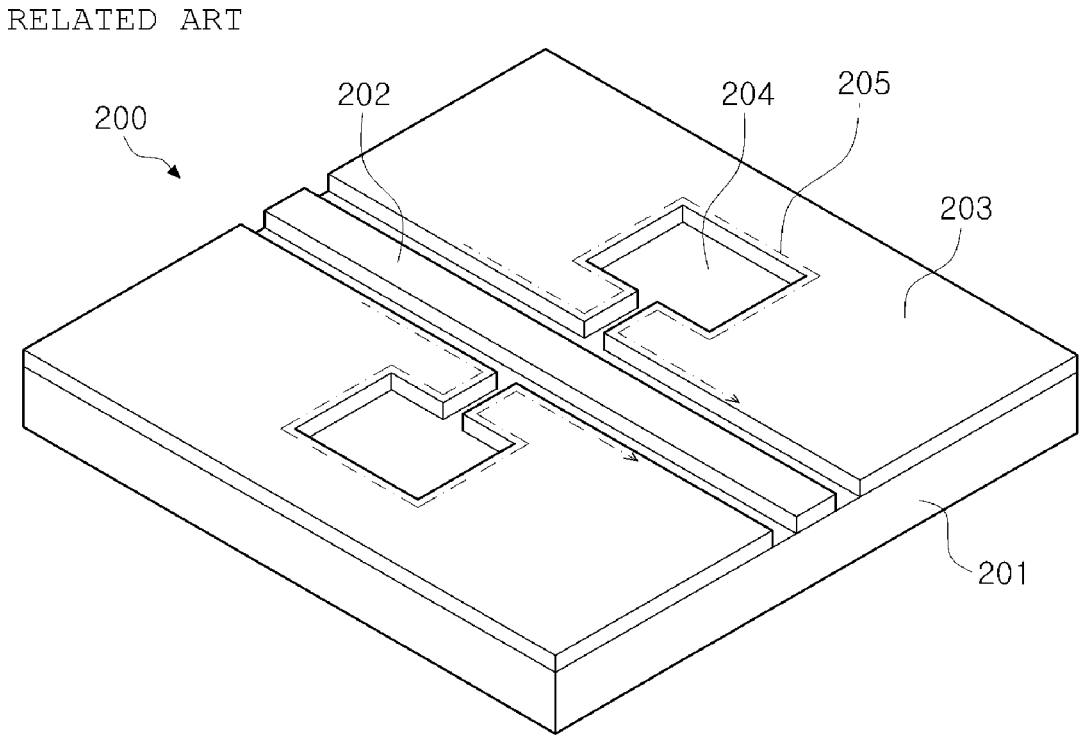

[Fig. 3]
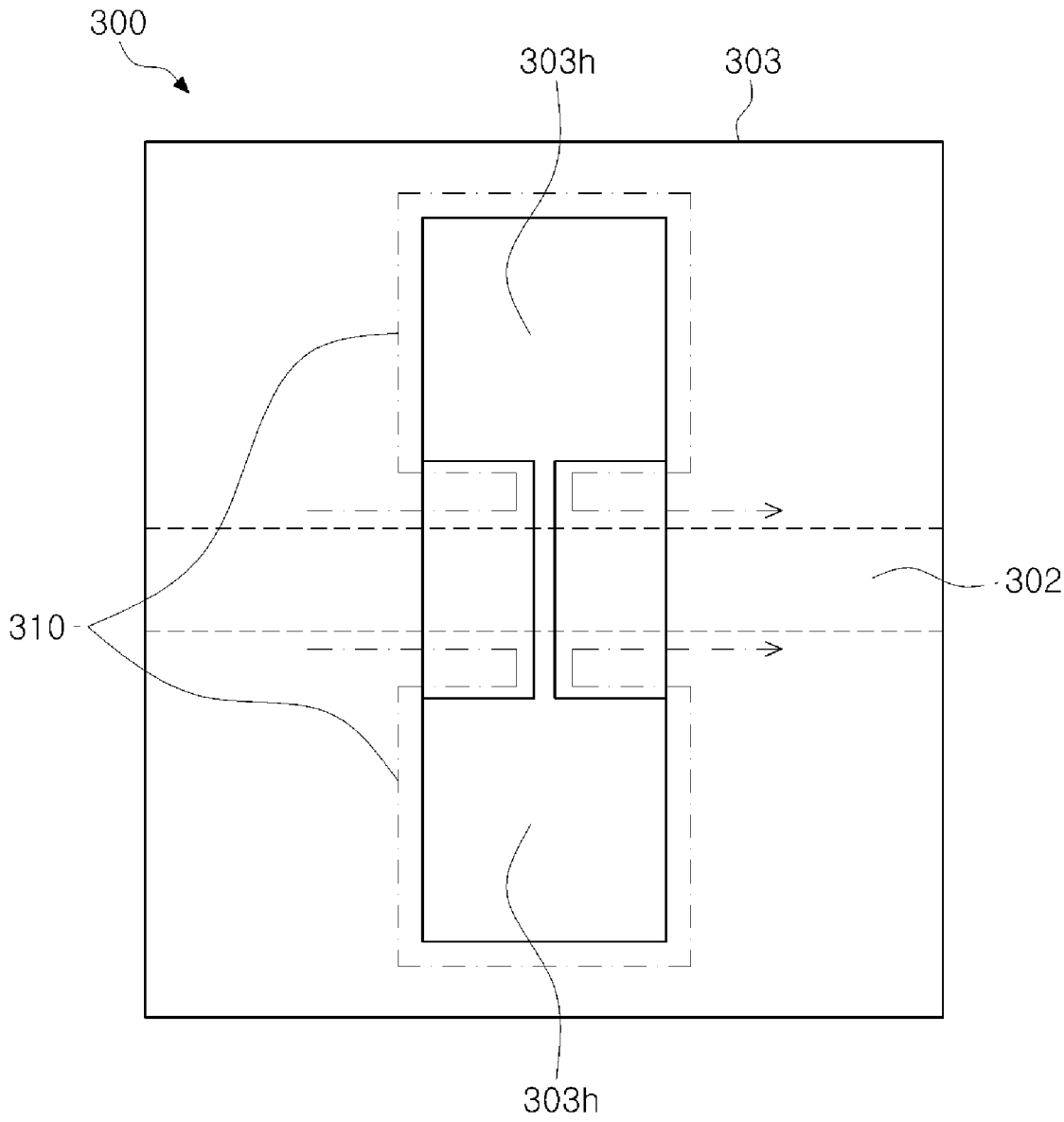

[Fig. 4]
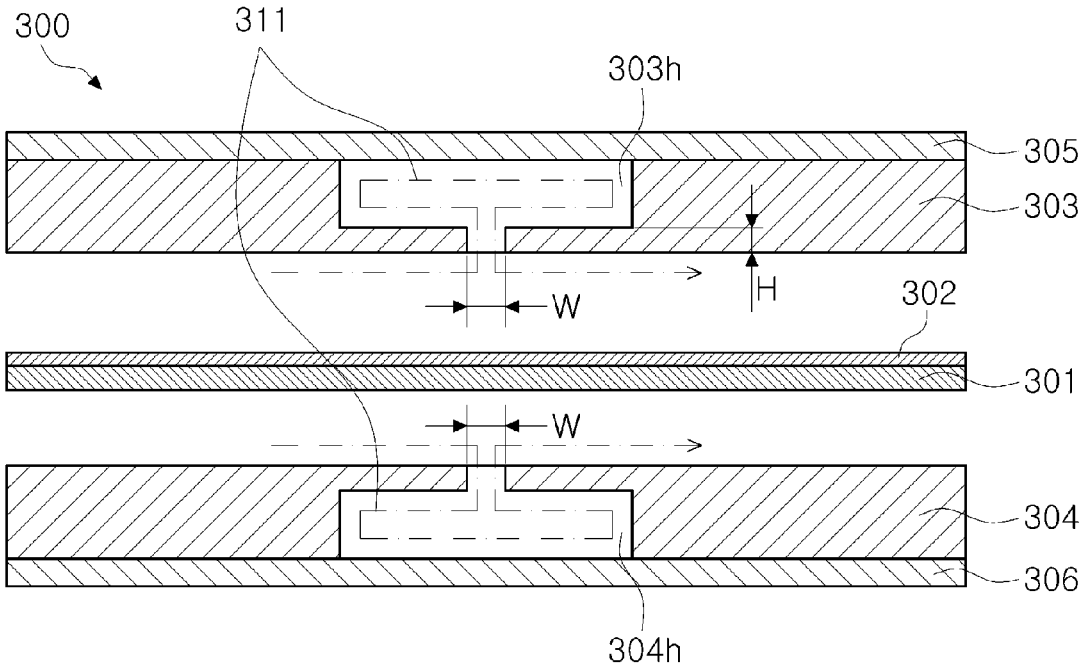

[Fig. 5]
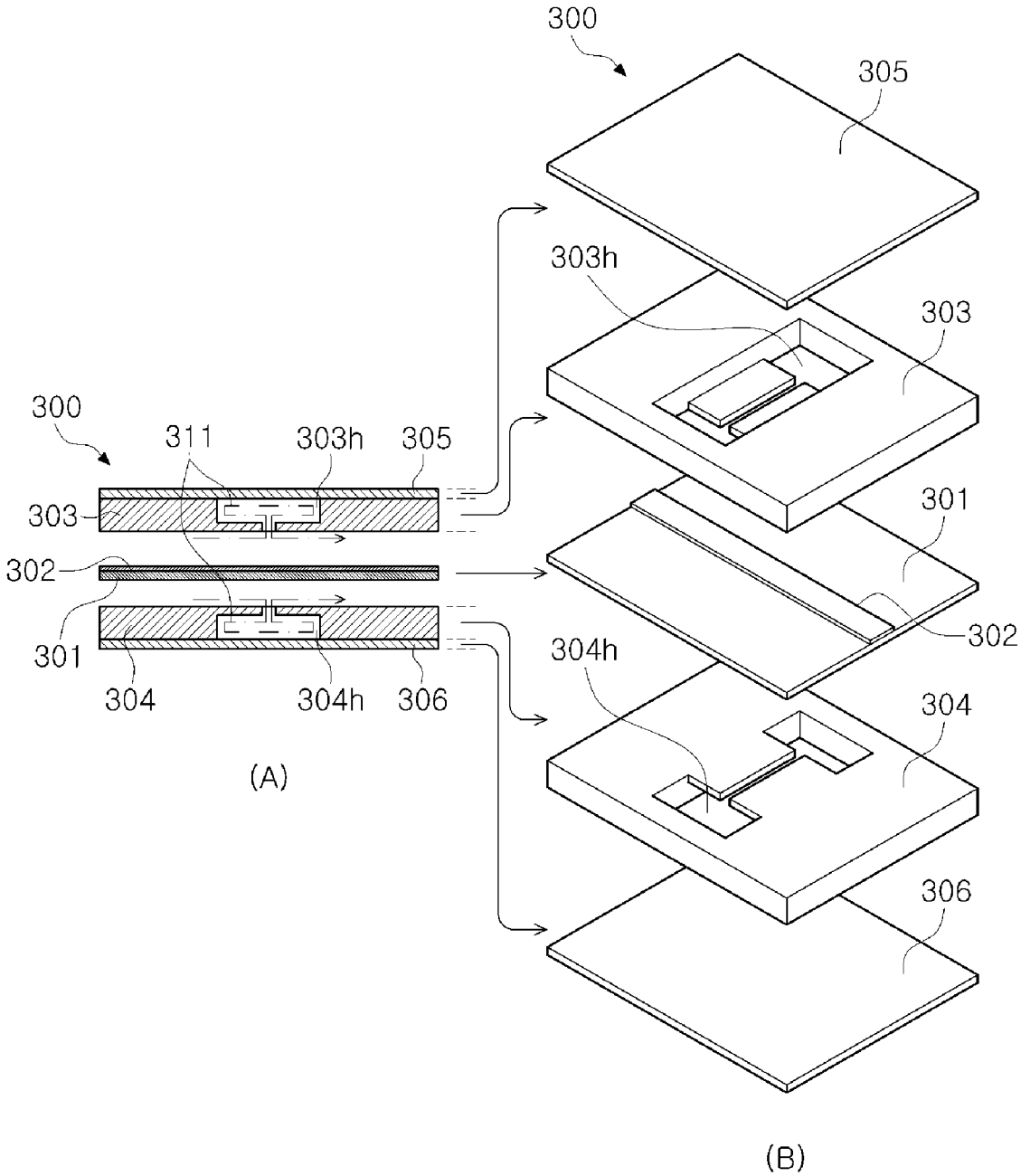

[Fig. 6]
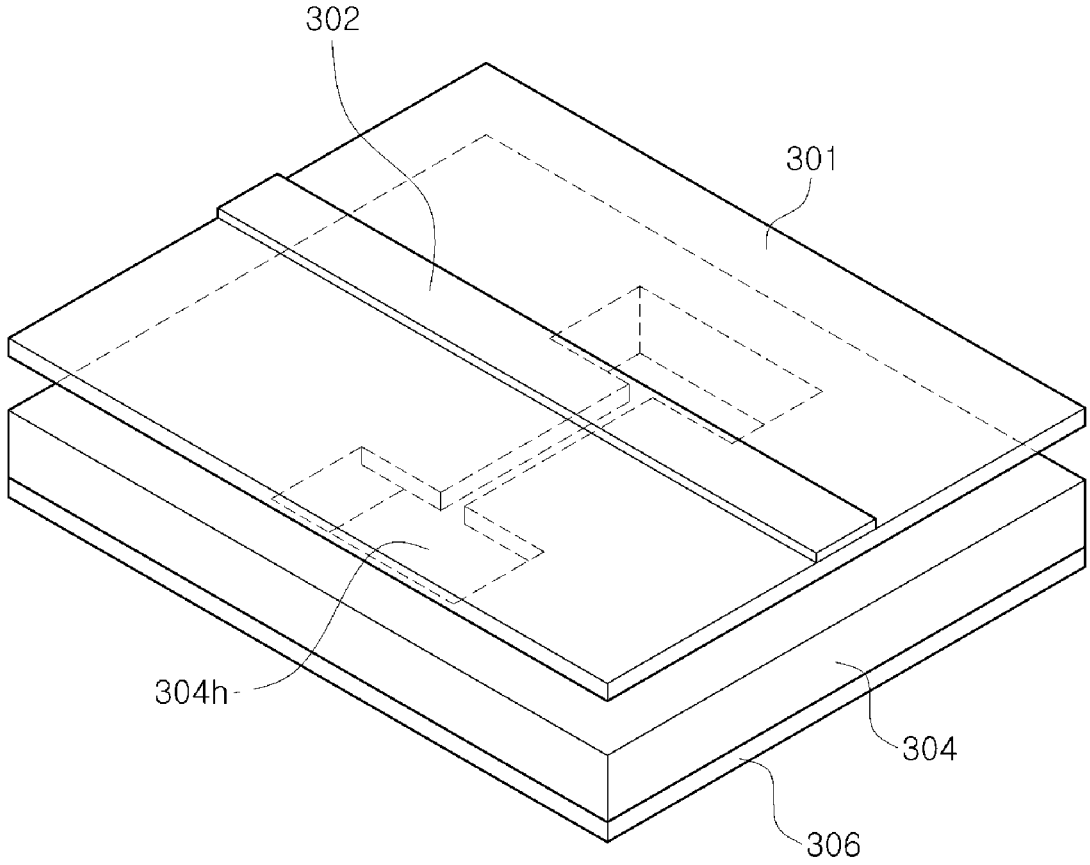

[Fig. 7]
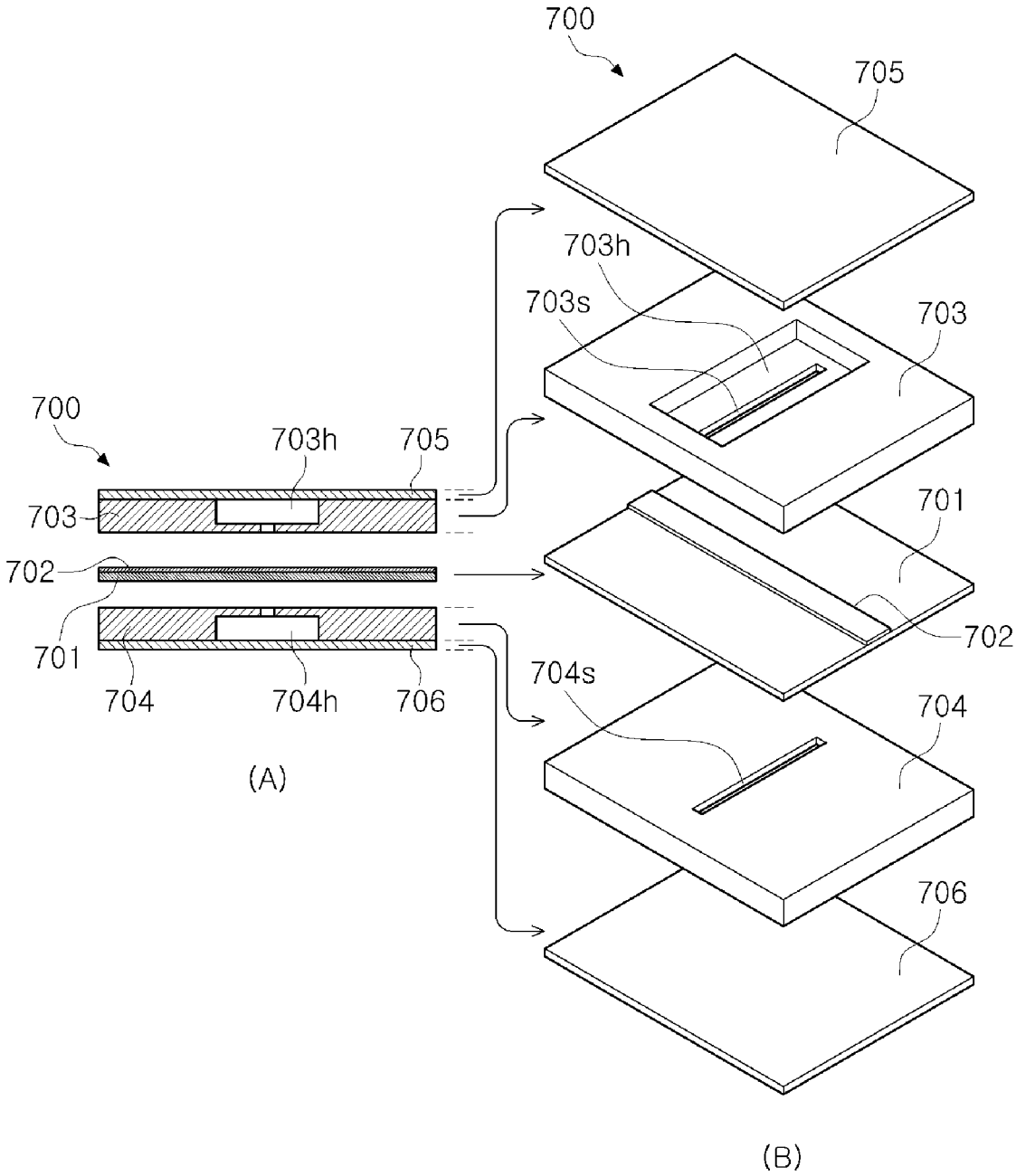

[Fig. 8]
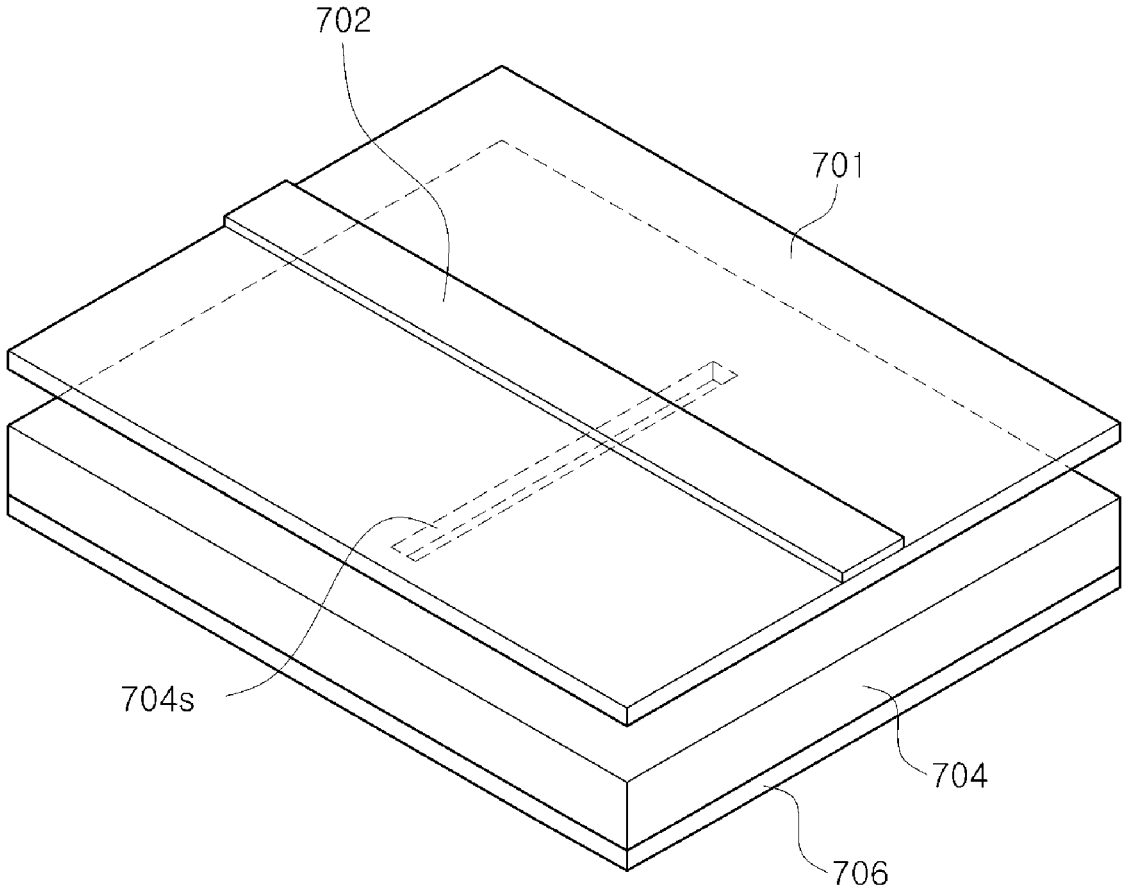

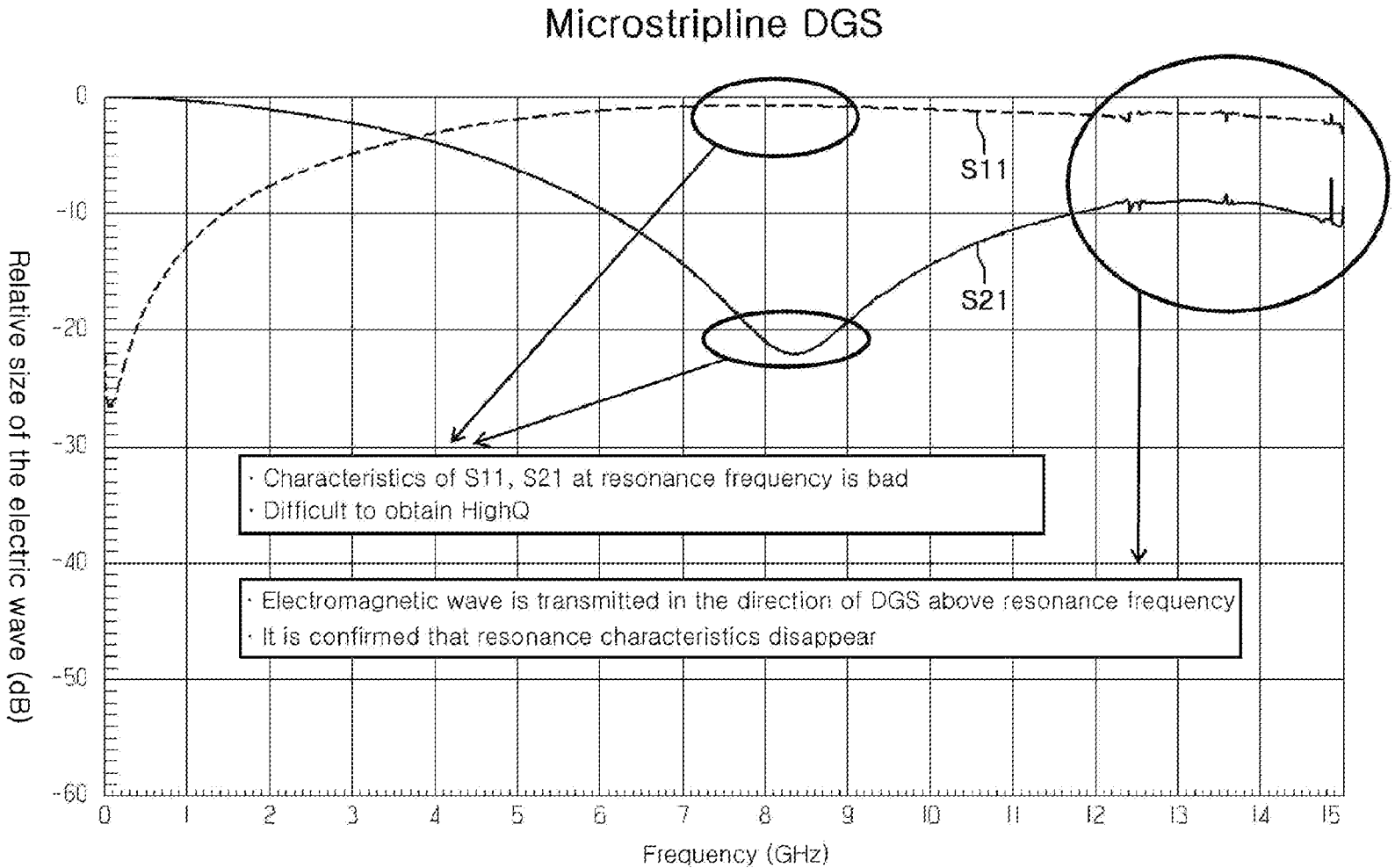
RELATED ART
[Fig. 9]

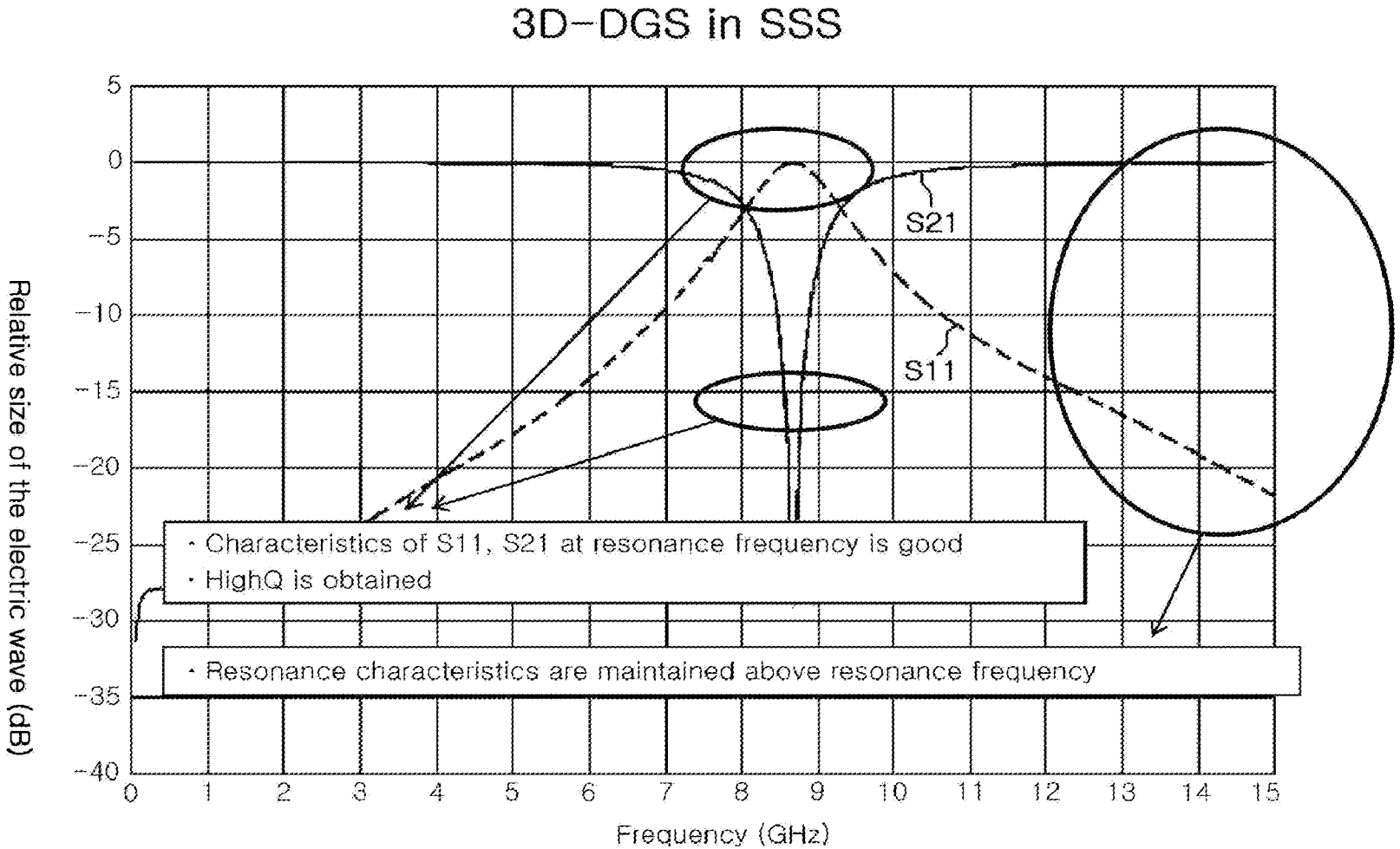
[Fig. 10]

RESONATOR HAVING A THREE DIMENSIONAL DEFECTED GROUND STRUCTURE IN TRANSMISSION LINE

TECHNICAL FIELD

The present invention relates to a resonator that can be used in a microwave communications system, and more specifically, to a resonator which has a three dimensional Defected Ground Structure (DGS) in the Suspended Substrate Stripline (SSS) transmission line structure and which shows high quality factor.

BACKGROUND ART

Recently, parallel resonators using microstripline structured DGS and co-planar waveguide (CPW) structured DGS have been introduced. These resonators, unlike conventional resonators, have a specific pattern such as a dumbbell-like form at the ground plane in order to construct a parallel resonator. The parallel resonator obtains capacitance characteristics through the gap of the ground plane defected in the form of dumbbell and gets inductance characteristics by changing the flow of current through the ground plane defected in the form of quadrilateral.

FIG. 1 and FIG. 2 illustrate the structure of a conventional parallel resonators having a microstripline DGS and a CPW DGS respectively.

In the parallel resonator 100 with microstripline DGS structure as shown in FIG. 1, a transmission line 102 with a characteristic impedance of 50 ohm (Ω) is installed on the substrate 101, and a DGS pattern 104 defected in the shape of a dumbbell is formed on the grounding member 103 on the bottom part of the substrate 101.

The parallel resonator 200 with CPW DGS structure, as shown in FIG. 2, comprises a transmission line 202 with a characteristic impedance of 50 ohm installed on a substrate 201, and grounding members 203 which are arranged on both sides of the transmission line 202, and each grounding member 203 has a DGS pattern 204 defected in the shape of a dumbbell respectively.

In the two types of parallel resonators described above, the resonators obtain characteristics of a parallel resonator as the flow of current 205 takes the form of the defect through the defect in the shape of a dumbbell. Describing in more detail, characteristics of a parallel resonator is achieved where the capacitance characteristics being generated in the narrow gap between the dumbbell-shaped defects and the inductance characteristics being generated by the circulating flow of the current in the wide quadrilateral shape.

The parallel resonators described above have adopted a new way of designing the resonator through the defect in the ground plane, which is different from the general way of designing the circuit of super-high frequency broadband. These resonators, however, have higher transmission loss of signals due to the current radiation in the rear direction caused by the ground plane defect, and lose the characteristics of a resonator especially at high frequencies. Also it is difficult to achieve high capacitance through the gap in the form of dumbbell owing to its structural problem.

Therefore the resonators cannot have high value of quality factor.

DISCLOSURE

The present invention has been designed considering the above-described problems. Its objective is to provide a resonator which has a three dimensional Defected Ground Structure (DGS) in the Suspended Substrate Stripline (SSS) transmission line structure and which shows high quality factor by decreasing transmission loss.

In order to achieve the object of the invention, the resonator having a three-dimensional DGS in the transmission line according to the first example of the present invention comprises a substrate installed at the center of the resonator floating in the air through supporting members installed on both ends of the substrate; a transmission line for transmitting signals installed on the upper surface of the substrate; an upper ground plane member installed on the upper surface of the substrate with predetermined interval from the surface of the substrate, wherein a DGS pattern with a predetermined shape is formed on each portion of the body of the ground plane member symmetrically with respect to the transmission line to form a resonator; a lower ground plane member installed on the lower surface of the substrate with predetermined interval from the surface of the substrate, wherein a DGS pattern with a predetermined shape is formed on each portion of the body of the ground plane member symmetrically with respect to the transmission line to form a resonator; an upper cover installed closely contacting the upper surface of the upper ground plane member to seal the upper opening of the DGS pattern formed on the upper ground plane member and to protect the upper ground plane member at the same time; and a lower cover installed closely contacting the lower surface of the lower ground plane member to seal the lower opening of the DGS pattern formed on the lower ground plane member and to protect the lower ground plane member at the same time.

The DGS patterns formed on the upper ground plane member and the lower ground plane member respectively are formed to be symmetrical in the shape of a dumbbell with respect to the substrate in the vertical plane centering around the substrate as well as symmetrical in the shape of a dumbbell with respect to the transmission line in the horizontal plane.

Also, to achieve the object of the invention, the resonator having a three-dimensional DGS in the transmission line according to the second example of the present invention comprises a substrate installed at the center of the resonator floating in the air through supporting members installed on both ends of the substrate; a transmission line for transmitting signals installed on the upper surface of the substrate; an upper ground plane member installed on the upper surface of the substrate with predetermined interval from the surface of the substrate, wherein a DGS pattern with rectangular-shape for constructing a resonator is formed perpendicularly to the transmission line; a lower ground plane member installed on the bottom surface of the substrate with predetermined interval from the surface of the substrate, wherein a DGS pattern with rectangular shape for constructing a resonator is formed perpendicularly to the transmission line; an upper cover installed closely contacting the upper surface of the upper ground plane member to seal the upper opening of the DGS pattern formed on the upper ground plane member and to protect the upper ground plane member at the same time; and a lower cover installed closely contacting the lower surface of the lower ground plane member to seal the lower opening of the DGS pattern formed on the lower ground plane member and to protect the lower ground plane member at the same time.

The DGS patterns formed in rectangular shape on the upper ground plane member and the lower ground plane member respectively are formed in a way that a rectangular-shaped groove with a predetermined depth from the surface of the surface member is formed on the surface of the upper and lower ground plane members and a through slot with a predetermined width is formed along the center of the floor of the groove in the longitudinal direction of the groove.

ADVANTAGEOUS EFFECT

According to the present invention, the resonator forms a parallel resonator structure having three dimensional DGS on both sides and on upper and lower portion of the transmission line based on the SSS transmission line structure. Also, the openings of the resonator are sealed through upper and lower covers. Accordingly, the resonator according to the present invention enables to gain high quality factor by reducing signal transmission loss.

BRIEF DESCRIPTION OF DRAWINGS

FIG. 1 illustrates the structure of a conventional parallel resonator having a microstripline DGS.

FIG. 2 illustrates the structure of a conventional parallel resonator having a CPW DGS.

FIG. 3 is an opened-up view of the resonator having a three dimensional DGS in the transmission line according to the first example of the present invention showing the DGS pattern and transmission line with the upper cover removed.

FIG. 4 is a cross-sectional view, cut in the longitudinal direction of the transmission line, of the resonator having a three dimensional DGS in the transmission line according to the first example of the present invention.

FIG. 5 is an exploded perspective view corresponding to the cross sectional view of FIG. 4.

FIG. 6 shows the DGS pattern formed on the lower ground plane member and the configuration of the transmission line on the substrate in the resonator having a three-dimensional DGS in the transmission line according to the first example of the present invention.

FIG. 7 is a cross-sectional view and an exploded perspective view of the resonator having a three dimensional DGS in the transmission line according to the second example of the present invention.

FIG. 8 shows the structure of the slot formed on the center portion of the DGS pattern of the lower ground plane member and the arrangement to the transmission line in the resonator having a three dimensional DGS in the transmission line according to the second example of the present invention.

FIG. 9 shows frequency characteristics of the resonator with a conventional microstripline DGS.

FIG. 10 shows frequency characteristics of the resonator having a three-dimensional DGS in the transmission line according to the present invention.

DESCRIPTION OF THE NUMERALS IN THE DRAWINGS

101,201,301,701 . . . substrate
102,202,302,702 . . . transmission line
103,203,303,304,703,704 . . . ground plane member
104,204,303*h*,304*h*,703*h*,704*h* . . . DGS pattern
205,310,311 . . . current flow
305,705 . . . upper cover
306,706 . . . lower cover
703*s*,704*s* . . . through slot

PREFERRED EMBODIMENT OF THE INVENTION

Now the present invention will be described in detail with reference to the drawings attached.

FIGS. 3-6 show the resonator having a three dimensional DGS in the transmission line according to the first example of the present invention. FIG. 3 is an opened-up view of the resonator having a three dimensional DGS in the transmission line according to the first example of the present invention showing the DGS pattern and transmission line with the upper cover removed. FIG. 4 shows the cross section cut in the longitudinal direction of center line. FIG. 5 is an exploded perspective view corresponding to the cross sectional view of FIG. 4. FIG. 6 shows detailed structure of the DGS pattern formed on the lower ground plane member and the configuration of the transmission line on the substrate.

Referring to FIGS. 3-6, the resonator 300 having a three-dimensional DGS in the transmission line according to the first example of the present invention includes a substrate 301, a transmission line 302, an upper grounding member 303, a lower grounding member 304, an upper cover 305 and a lower cover 306.

The substrate 301 is located in the center of the device (the resonator), and installed suspending in the space through supporting member (not illustrated) at both ends of the device.

The transmission line 302 is installed on the upper surface of the substrate 301 for transmitting a signal (communication electromagnetic wave signal, for example). SSS (Suspended Substrate Stripline) can be used for the transmission line.

The upper ground plane member 303 is installed on the upper surface of the substrate 301 with predetermined interval from the surface of the substrate, and a DGS pattern 303*h* with a predetermined shape is formed on both sides, that is, on each portion of the body of the ground plane member symmetrically with respect to the transmission line 302 to form a resonator. In forming the DGS pattern 303*h*, high capacitance can be obtained by forming the DGS pattern 303*h* controlling the height H and the width W of the gap of the pattern. The upper ground plane member 303 is made from conductive material such as Au, Pt or Cu.

The lower ground plane member 304 is installed on the lower surface of the substrate 301 with predetermined interval from the surface of the substrate, and a DGS pattern 304*h* with a predetermined shape is formed on both sides, that is, on each portion of the body of the ground plane member symmetrically with respect to the transmission line 302 to form a resonator. The lower ground plane member 303 is made from conductive material such as Au, Pt or Cu.

The DGS patterns 303*h*, 304*h* formed on the upper ground plane member 303 and the lower ground plane member 304 respectively are formed to be symmetrical in the shape of a dumbbell with respect to the substrate 301 in the vertical plane centering around the substrate 301 as shown in FIG. 4 as well as symmetrical in the shape of a dumbbell with respect to the transmission line 302 in the horizontal plane as shown in FIG. 3. Therefore, the flow of current 310 flows around through both sides of the transmission line 302 along the DGS pattern 303*h*, 304*h* in the shape of a dumbbell as shown in FIG. 3 (the flow has the same trace in the DGS pattern 304*h* of the lower grounding member 304 as that of the DGS pattern 303*h* of the upper grounding member 303), and the flow of current 311 also flows around through upper and lower parts of the substrate 301 along the DGS pattern 303*h*, 304*h*.

The upper cover 305 is installed closely contacting the upper surface of the upper ground plane member 303 to seal the upper opening of the DGS pattern 303*h* formed on the upper ground plane member 303 and to protect the upper ground plane member 303 at the same time. Since the upper opening of the DGS pattern 303*h* formed on the upper ground plane member 303 is sealed by the upper cover 305, the radiation of current in the rear direction of the ground plane as in the conventional resonators of FIGS. 1 and 2 is prevented thereby preventing transmission loss of signals. The upper cover 305 is made from the same material as that of the upper ground plane member 303 or from different material from that of the upper ground plane member 303.

The lower cover 306 is installed closely contacting the lower surface of the lower ground plane member 304 to seal the lower opening of the DGS pattern 304*h* formed on the lower ground plane member 304 and to protect the lower ground plane member 304 at the same time. Since the lower opening of the DGS pattern 304*h* formed on the lower ground plane member 304 is sealed by the lower cover 306, the radiation of current in the rear direction of the ground plane as in the conventional resonators is prevented thereby preventing transmission loss of signals as in the case of the upper cover 305. The lower cover 306 is made from the same material as that of the lower ground plane member 304 or from different material from that of the lower ground plane member 304.

FIGS. 7 and 8 illustrate the resonator having a three dimensional DGS in the transmission line according to the second example of the present invention. FIG. 7 is a cross-sectional view and an exploded perspective view of the resonator and FIG. 8 shows the structure of the slot formed on the center portion of the DGS pattern of the lower ground plane member and the arrangement to the transmission line in the substrate.

Referring to FIGS. 7 and 8, the resonator 700 having a three-dimensional DGS in the transmission line according to the second example of the present invention includes a substrate 701, a transmission line 702, an upper grounding member 703, a lower grounding member 704, an upper cover 705 and a lower cover 706.

The substrate 701 is located at the center of the device (the resonator), and installed suspending in the space through supporting member (not illustrated) at both ends of the device.

The transmission line 702 is installed on the upper surface of the substrate 701 for transmitting a signal (communication electromagnetic wave signal, for example). SSS (Suspended Substrate Stripline) can be used for the transmission line.

The upper ground plane member 703 is installed on the upper surface of the substrate 701 with predetermined interval from the surface of the substrate, and a DGS pattern 703*h* with a rectangular shape is formed perpendicularly crossing the transmission line 302 to form a resonator. The upper ground plane member 703 is made from conductive material such as Au, Pt or Cu.

The lower ground plane member 704 is installed on the lower surface of the substrate 701 with predetermined interval from the surface of the substrate, and a DGS pattern 704*h* with a rectangular shape is formed perpendicularly crossing the transmission line 302 to form a resonator. The lower ground plane member 704 is made from conductive material such as Au, Pt or Cu.

The DGS patterns 703*h*, 704*h* formed in rectangular shape on the upper ground plane member 703 and the lower ground plane member 704 respectively are formed in a way that a rectangular-shaped groove with a predetermined depth from the surface of the surface member is formed on the surface of the upper and lower ground plane members 703, 704 and a through slot 703*s*, 704*s* with a predetermined width is formed along the center of the floor of the rectangular groove in the longitudinal direction of the groove. Also, various circuits and very sharp resonator characteristics can be obtained by forming the slot 703*s*, 704*s* in various forms.

The upper cover 705 is installed closely contacting the upper surface of the upper ground plane member 703 to seal the upper opening of the DGS pattern 703*h* formed on the upper ground plane member 703 and to protect the upper ground plane member 703 at the same time. The upper cover 705 is made from the same material as that of the upper ground plane member 703 or from different material from that of the upper ground plane member 703.

The lower cover 706 is installed closely contacting the lower surface of the lower ground plane member 704 to seal the lower opening of the DGS pattern 704*h* formed on the lower ground plane member 704 and to protect the lower ground plane member 704 at the same time. The lower cover 706 is made from the same material as that of the lower ground plane member 704 or from different material from that of the lower ground plane member 704.

Meanwhile, FIG. 9 shows frequency characteristics of the resonator with a conventional microstrip DGS, and FIG. 10 shows frequency characteristics of the resonator having a three-dimensional DGS in the transmission line according to the present invention.

As illustrated in FIG. 9, in the resonator with a conventional microstrip DGS, signal transmission loss increases by current radiation as frequency increases and shows bad characteristics of reflection wave S11 and transmission wave S21 at resonance frequency. Therefore, it is difficult to obtain high quality factor. Furthermore, electromagnetic wave is emitted in the rear direction of DGS as the frequency increases above resonance frequency thereby eliminating the resonance characteristics.

In the resonator having a three-dimensional DGS in the transmission line according to the present invention, however, there is no loss of signal transmission when the frequency increases as shown in FIG. 10. Therefore, good characteristics of reflection wave S11 and transmission wave S21 at resonance frequency can be obtained ensuring high quality factor. Also, it can be seen that the resonance characteristics are maintained even though the frequency increases above resonance frequency.

As described above, the resonator having a three-dimensional DGS in the transmission line according to the present invention form a parallel resonator structure in the right and left sides and in the upper and lower portion of the transmission line based on the SSS transmission line structure, and has the structure wherein the openings of each DGS is sealed by upper and lower cover, ensuring high quality factor by reducing signal transmission loss. Therefore, performance with high credibility can be obtained when the resonator of the present invention is applied to the circuits and modules to which small resonators with super-high frequency range are applied.

Also, the resonator having a three-dimensional DGS in the transmission line according to the present invention can be applied to the microstrip line structure or rectangular waveguide.

Although preferable examples of the present invention have been described in detail, they should not be interpreted to limit the present invention, and any obvious modification of the examples by those skilled in the art should be deemed to be included in the scope of the invention as long as the modification is within the technical idea of the present invention. Therefore, the scope of the invention should be interpreted based on the claims of all the technical ideas which are equivalent to that of the present invention should be deemed to be included in the scope of the present invention.

What is claimed is:

1. A resonator having a three-dimensional DGS in a transmission line, comprising:

a substrate installed at a center of the resonator floating in air through supporting members installed on both ends of the substrate;

the transmission line for transmitting signals installed on an upper surface of the substrate;

an upper ground plane member installed on the upper surface of the substrate with a predetermined interval from the upper surface of the substrate, wherein a DGS pattern with a predetermined shape is formed on each portion of a body of the upper ground plane member symmetrically with respect to the transmission line to form the resonator;

a lower ground plane member installed on a lower surface of the substrate with a predetermined interval from the lower surface of the substrate, wherein a DGS pattern with a predetermined shape is formed on each portion of a body of the lower ground plane member symmetrically with respect to the transmission line to form the resonator;

an upper cover installed closely contacting the upper surface of the upper ground plane member to seal an upper opening of the DGS pattern formed on the upper ground plane member and to protect the upper ground plane member at the same time; and a lower cover installed closely contacting the lower surface of the lower ground plane member to seal a lower opening of the DGS pattern formed on the lower ground plane member and to protect the lower ground plane member at the same time.

2. The resonator according to claim 1, wherein the DGS patterns formed on the upper ground plane member and the lower ground plane member respectively are formed to be symmetrical in a shape of a dumbbell with respect to the substrate in a vertical plane centering around the substrate as well as symmetrical in the shape of a dumbbell with respect to the transmission line in a horizontal plane.

3. A resonator having a three-dimensional DGS in the transmission line, comprising:

a substrate installed at a center of the resonator floating in the air through supporting members installed on both ends of the substrate;

a transmission line for transmitting signals installed on an upper surface of the substrate;

an upper ground plane member installed on the upper surface of the substrate with a predetermined interval from the upper surface of the substrate, wherein a DGS pattern with rectangular shape for constructing the resonator is formed perpendicularly to the transmission line;

a lower ground plane member installed on a bottom surface of the substrate with a predetermined interval from the bottom surface of the substrate, wherein a DGS pattern with rectangular shape for constructing the resonator is formed perpendicularly to the transmission line;

an upper cover installed closely contacting the upper surface of the upper ground plane member to seal an upper opening of the DGS pattern formed on the upper ground plane member and to protect the upper ground plane member at the same time; and a lower cover installed closely contacting the bottom surface of the lower ground plane member to seal a lower opening of the DGS pattern formed on the lower ground plane member and to protect the lower ground plane member at the same time.

4. The resonator according to claim 3, wherein the DGS patterns formed in rectangular shape on the upper ground plane member and the lower ground plane member respectively are formed in a way that a rectangular-shaped groove with a predetermined depth from the surface of a surface member is formed on the surface of the upper and lower ground plane members and a through slot with a predetermined width is formed along a center of a floor of the groove in a longitudinal direction of the groove.

5. The resonator according to claim 1, wherein the transmission line is a suspended substrate stripline.

6. The resonator according to claim 1, wherein the upper ground plane member is formed from Au, Pt or Cu.

7. The resonator according to claim 1, wherein the lower ground plane member is formed from Au, Pt or Cu.

8. The resonator according to claim 1, wherein the upper cover is made from a same material as that of the upper ground plane member.

9. The resonator according to claim 1, wherein the upper cover is made from a different material as that of the upper ground plane member.

10. The resonator according to claim 1, wherein the lower cover is made from a same material as that of the lower ground plane member.

11. The resonator according to claim 1, wherein the lower cover is made from a different material as that of the lower ground plane member.

12. The resonator according to claim 3, wherein the transmission line is a suspended substrate stripline.

13. The resonator according to claim 3, wherein the upper ground plane member is formed from Au, Pt or Cu.

14. The resonator according to claim 3, wherein the lower ground plane member is formed from Au, Pt or Cu.

15. The resonator according to claim 3, wherein the upper cover is made from a same material as that of the upper ground plane member.

16. The resonator according to claim 3, wherein the upper cover is made from a different material as that of the upper ground plane member.

17. The resonator according to claim 3, wherein the lower cover is made from a same material as that of the lower ground plane member.

18. The resonator according to claim 3, wherein the lower cover is made from a different material as that of the lower ground plane member.

* * * * *